US008912471B2

(12) United States Patent
Shigeoka et al.

(10) Patent No.: US 8,912,471 B2
(45) Date of Patent: Dec. 16, 2014

(54) HEATING COOKER

(75) Inventors: Takehiko Shigeoka, Nara (JP); Akira Kataoka, Shiga (JP); Eiji Matsui, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/386,614

(22) PCT Filed: Jul. 2, 2010

(86) PCT No.: PCT/JP2010/004349
§ 371 (c)(1),
(2), (4) Date: Jan. 23, 2012

(87) PCT Pub. No.: WO2011/010429
PCT Pub. Date: Jan. 27, 2011

(65) Prior Publication Data

US 2012/0118281 A1 May 17, 2012

(30) Foreign Application Priority Data

Jul. 24, 2009 (JP) ..... 2009-172691

(51) Int. Cl.

| | |
|---|---|
| ***H05B 6/12*** | (2006.01) |
| ***F27D 11/00*** | (2006.01) |
| ***F27B 14/00*** | (2006.01) |
| ***H05B 3/02*** | (2006.01) |
| ***F21V 33/00*** | (2006.01) |
| ***F24C 1/00*** | (2006.01) |
| ***F24C 7/08*** | (2006.01) |

(52) U.S. Cl.
CPC ..... *H05B 6/1218* (2013.01); *F24C 7/083* (2013.01)
USPC ..... 219/621; 219/385; 219/487; 219/620; 219/622; 219/623; 219/624; 219/625; 219/626; 219/627; 219/427; 362/92; 362/307; 362/308; 362/309

(58) Field of Classification Search
CPC .... B23K 3/0607; B29B 13/021; B29B 45/72; B29C 45/72; H05B 6/12; H05B 6/1263; A47J 36/02
USPC ..... 219/385, 427, 452.11, 487; 362/92; 392/307–309
See application file for complete search history.

(56) References Cited

U.S. PATENT DOCUMENTS 3,719,789 A * 3/1973 Harnden, Jr. ..... 219/627
3,742,174 A * 6/1973 Harnden, Jr. ..... 219/627
(Continued)

FOREIGN PATENT DOCUMENTS

CN 101227772 A 7/2008
DE 1858 299 A2 5/2007
(Continued)

OTHER PUBLICATIONS

International Search Report for International Application No. PCT/JP2010/004349, dated Oct. 26, 2010, 3 pages.
(Continued)

*Primary Examiner* — Dana Ross
*Assistant Examiner* — Gyounghyun Bae
(74) *Attorney, Agent, or Firm* — Brinks Gilson & Lione

(57) ABSTRACT

A heating cooker of the present invention includes a plurality of light emitting indicator units. The light emitting indicator units each have a temperature sensing unit that senses an ambient temperature of a light emission source. Therefore, deterioration of the light emission source of each of the light emitting indicator units can be suppressed to realize a further reduction in thickness, and to improve visibility of the indicator sheet.

10 Claims, 5 Drawing Sheets

(56) References Cited

U.S. PATENT DOCUMENTS

| | | | | |
|---|---|---|---|---|
| 4,617,441 | A * | 10/1986 | Koide et al. | 219/627 |
| 4,638,135 | A * | 1/1987 | Aoki | 219/627 |
| 5,841,112 | A * | 11/1998 | Brooks et al. | 219/506 |
| 6,140,617 | A * | 10/2000 | Berkcan et al. | 219/446.1 |
| 6,949,729 | B1 * | 9/2005 | Ishikawa et al. | 219/702 |
| 6,969,834 | B2 * | 11/2005 | Kaji et al. | 219/620 |
| 7,109,450 | B2 * | 9/2006 | Kaji et al. | 219/620 |
| 7,173,221 | B2 * | 2/2007 | Lerner | 219/445.1 |
| 7,402,781 | B2 * | 7/2008 | Kondo et al. | 219/622 |
| 7,425,690 | B2 * | 9/2008 | Schilling | 219/451.1 |
| 7,465,082 | B2 | 12/2008 | Sakamoto et al. | |
| 7,473,872 | B2 * | 1/2009 | Takimoto | 219/627 |
| 7,554,060 | B2 * | 6/2009 | England et al. | 219/480 |
| 7,625,098 | B2 * | 12/2009 | Rains et al. | 362/231 |
| 7,667,163 | B2 * | 2/2010 | Ashworth et al. | 219/502 |
| 7,814,691 | B2 | 10/2010 | Thimm | |
| 7,985,008 | B2 * | 7/2011 | Kaisser et al. | 362/328 |
| 2004/0238524 | A1 * | 12/2004 | Lerner | 219/445.1 |
| 2004/0245244 | A1 * | 12/2004 | Hirota et al. | 219/624 |
| 2006/0091135 | A1 * | 5/2006 | Kondo et al. | 219/621 |
| 2006/0245208 | A1 | 11/2006 | Sakamoto et al. | |
| 2007/0267406 | A1 | 11/2007 | Thimm | |
| 2009/0134149 | A1 * | 5/2009 | Keishima et al. | 219/647 |
| 2010/0219181 | A1 * | 9/2010 | Kusaka et al. | 219/650 |
| 2011/0011851 | A1 | 1/2011 | Kataoka et al. | |

FOREIGN PATENT DOCUMENTS

| | | | |
|---|---|---|---|
| EP | 1213543 | A1 | 6/2002 |
| EP | 1536668 | A1 | 6/2005 |
| JP | S59-65404 | | 5/1984 |
| JP | 03-58087 | A | 3/1991 |
| JP | 07-312280 | | 11/1995 |
| JP | 2000-182762 | A | 6/2000 |
| JP | 2002-175874 | | 6/2002 |
| JP | 2003-133042 | A | 5/2003 |
| JP | 2003-234168 | | 8/2003 |
| JP | 2004-047283 | | 2/2004 |
| JP | 2004-247186 | A | 9/2004 |
| JP | 2004-281343 | A | 10/2004 |
| JP | 2004-355962 | A | 12/2004 |
| JP | 2005-100998 | A | 4/2005 |
| JP | 2007-194100 | | 8/2007 |
| JP | 2008-288085 | | 11/2008 |
| JP | 2009-006048 | A | 1/2009 |
| WO | WO 2004/023846 | A1 | 3/2004 |
| WO | WO 2009/113235 | A1 | 9/2009 |

OTHER PUBLICATIONS

Translation of the International Preliminary Report on Patentability for International Application No. PCT/JP2010/004349, dated Mar. 6, 2012, 4 pages.

Office Action dated May 13, 2014 corresponding to Japanese Patent Application No. 2011-523541, (4p).

European Search Report of EP Application No. 10802051.2—1808/2458935, dated Jul. 9, 2014 (6p).

Japanese Office Action corresponding Japanese Patent Application No. 2011-523541 on Jul. 22, 2014 and translation, (3p).

* cited by examiner

HEATING COOKER

This application is a 371 application of PCT/JP2010/004349 having an international filing date of Jul. 2, 2010, which claims priority to JP2009-172691 filed on Jul. 24, 2009, the entire contents of which are incorporated herein by reference.

TECHNICAL FIELD

The present invention relates to a heating cooker including light emitting indicator units that indicate the position at which a heating target cooking vessel is to be placed, or that indicate that the heating unit is in the heating state.

BACKGROUND ART

In recent years, the opening and closing manner of a storage unit of a kitchen cabinet has been shifting from the door type to the drawer type in order to improve the usability. Further, a storage unit is also provided below a heating cooker such as an induction heating cooker, which is conventionally installed in a kitchen cabinet. Here, as to such a storage unit also, the drawer type storage unit is becoming popular. There is demand for a kitchen cabinet securing a further greater storage capacity. In order to secure a greater capacity of the storage unit below the heating cooker, development of a thin heating cooker that does not project toward the storage unit is desired.

An exemplary conventional heating cooker is disclosed in Patent Document 1 (Japanese Unexamined Patent Publication No. 2004-247186). FIG. 6 is a plan view of a conventional heating cooker. FIG. 7 is a cross-sectional view of the heating cooker shown in FIG. 6. FIG. 8 is a cross-sectional view of a light emitting indicator unit included in the heating cooker shown in FIG. 6. FIG. 9 is a perspective view showing the state in which the heating cooker shown in FIG. 6 is installed in a kitchen cabinet.

As shown in FIGS. 7 and 9, the conventional heating cooker includes a box-like body 41 having an opening at its top portion, and a flat plate-like top board 42 that is disposed to close the opening of the body 41, on which a heating target cooking vessel (not shown) such as a pot is placed.

As shown in FIG. 7, one or more heating units 43 are disposed inside the body 41. Each of the heating units 43 is structured with, for example, a substantially circular induction heating coil that heats the heating target cooking vessel via the top board 42. Below each heating unit 43, a control device 44 that controls the output of the heating unit 43 is provided. Further, beside each heating unit 43, a light emitting indicator unit 45 is provided. Each light emitting indicator unit 45 indicates the position at which the heating target cooking vessel is to be placed or indicates that the heating unit 43 is in the heating state, when the heating target cooking vessel is heated by the heating unit 43.

As shown in FIG. 8, each of the light emitting indicator units 45 includes a box-like body 46 having a light blocking characteristic, and a light emission source 47 disposed on the inner face of the bottom wall of the box-like body 46. The light emission source 47 is structured with a point light source such as a lead type bullet LED. The box-like body 46 is disposed such that its top portion faces the top board 42. An opening 48 is provided at the top portion of the box-like body 46, and the opening 48 is covered by an indicator sheet 49. The indicator sheet 49 is structured with a translucent material so that it is illuminated by the light emitted from the light emission source 47 and passed through the opening 48, and shines in its entirety. The light emission source 47 and the indicator sheet 49 are disposed to have a space therebetween such that uneven shining of the indicator sheet 49 is reduced.

Patent Document 1: Japanese Unexamined Patent Publication No. 2004-247186

SUMMARY OF THE INVENTION

Problems to be Solved by the Invention

In order to reduce in thickness of the conventional heating cooker described above, it is considered to be effective to suppress the height of each light emitting indicator unit 45. In order to suppress the height of each light emitting indicator unit 45, the space between the light emission source 47 and the indicator sheet 49 may be narrowed.

However, when the space between the light emission source 47 and the indicator sheet 49 is narrowed, by the heat of the heating target cooking vessel transferred to the light emitting indicator unit 45 via the top board 42 deteriorates the light emission source 47, whereby the brightness is reduced and lifetime is shortened. In particular, in a case where the heating target cooking vessel becomes empty while being heated, since the temperature of the heating target cooking vessel rises to approximate, e.g., 300° C., deterioration of the light emission source 47 becomes significant.

In order to reduce the effect of the heat from the heating target cooking vessel, the indicator sheet 49 disposed between the light emission source 47 and the top board 42 may be structured with a heat insulating material. However, since the heat insulating material absorbs light, it cannot fully function as the indicator sheet 49.

Further, with the conventional heating cooker described above, there is an issue that, when the heating target cooking vessel is disposed above the indicator sheet 49 as being displaced from the position at which it should originally be placed, the indicator sheet 49 cannot be visually recognized.

Accordingly, an object of the present invention is to solve the issue stated above, and to provide a heating cooker including light emitting indicator units which is capable of suppressing deterioration of the light emission source of each light emitting indicator unit, achieving a further reduction in thickness, and improving visibility of each indicator sheet.

Means for Solving the Problems

In order to achieve the object stated above, the present invention is structured as follows.

According to a first aspect of the present invention, there is provided a heating cooker, comprising:

a box-like body having an opening at top portion of the body;

a top board that is provided to close the opening of the body;

a heating unit that is provided inside the body and that heats a heating target cooking vessel placed on the top board;

a plurality of light emitting indicator units that are provided beside the heating unit; and a control unit that controls the heating unit and the light emitting indicator units, wherein the light emitting indicator units each have a light emission source, and a temperature sensing unit that senses an ambient temperature of the light emission source.

According to a second aspect of the present invention, there is provided the heating cooker as defined in first aspect, wherein when there is any light emitting indicator unit whose temperature sensed by the temperature sensing unit becomes equal to or higher than a reference temperature out of a plurality of the light emitting indicator units, the reference temperature being equal to or lower than a heat resistant temperature of the light emission source, the control unit reduces a current for energizing the light emission source of the light emitting indicator unit.

According to a third aspect of the present invention, there is provided the heating cooker as defined in first aspect, wherein when there is any light emitting indicator unit whose temperature sensed by the temperature sensing unit becomes equal to or higher than a reference temperature out of a plurality of the light emitting indicator units, the reference temperature being equal to or lower than a heat resistant temperature of the light emission source, the control unit reduces an output of the heating unit.

According to a fourth aspect of the present invention, there is provided the heating cooker as defined in first aspect, wherein the light emitting indicator units each include:

a case that stores the light emission source, the case having an opening at top portion of the case facing the top board; and an indicator sheet that is provided to close the opening of the case, wherein the indicator sheet includes:

a light transmitting portion that passes light of the light emission source; and a light blocking portion that is provided at a position away from the heating unit than the light transmitting portion is, the light blocking portion blocking the light of the light emission source, and wherein the light emission source is disposed below the light blocking portion.

According to a fifth aspect of the present invention, there is provided the heating cooker as defined in fourth aspect, wherein at least one light emitting indicator unit out of a plurality of the light emitting indicator units has a light blocking wall between the light transmitting portion of the indicator sheet and the light emission source as seen from a height direction, the light blocking wall blocking the light of the light emission source.

According to a sixth aspect of the present invention, there is provided the heating cooker as defined in fifth aspect, wherein a clearance that passes the light of the light emission source is provided between the light blocking wall and the indicator sheet.

According to a seventh aspect of the present invention, there is provided the heating cooker as defined in fifth aspect, wherein the light blocking wall has a heat insulating characteristic.

According to an eighth aspect of the present invention, there is provided the heating cooker as defined in any one of first aspect to seventh aspect, wherein the control unit senses a position of the heating target cooking vessel placed on the top board based on a difference among temperatures sensed by the temperature sensing units of the light emitting indicator units.

According to a ninth aspect of the present invention, there is provided the heating cooker as defined in eighth aspect, wherein when the heating target cooking vessel is disposed as being displaced from a position at which the heating target cooking vessel is to be placed, the control unit allows a light emission source of at least one light emitting indicator unit out of a plurality of the light emitting indicator units to emit light so as to report to a user.

According to a tenth aspect of the present invention, there is provided the heating cooker as defined in ninth aspect, wherein when the heating target cooking vessel is disposed as being displaced from the position at which the heating target cooking vessel is to be placed, the control unit allows the light emission source of at least one light emitting indicator unit out of a plurality of the light emitting indicator units to emit light in a color being different from a color that is emitted when the heating target cooking vessel is disposed at the position at which the heating target cooking vessel is to be placed.

Effects of the Invention

With the heating cooker of the present invention, since the temperature sensing unit that senses the ambient temperature of the light emission source is included, it becomes possible to sense the abnormal heating of the light emission source which may be caused by the heating target cooking vessel being heated while empty. Thus, it becomes possible to carry out processes such as reporting the abnormal heating of the light emission source to the user, automatically reducing the current for energizing the light emission source, and automatically reducing the output of the heating unit. Thus, deterioration of the light emission source can be suppressed. Accordingly, the height of the light emitting indicator units can be suppressed, and a further reduction in the thickness of the heating cooker can be realized.

Further, with the heating cooker of the present invention, since a plurality of light emitting indicator units are included, even in a case where the heating target cooking vessel is disposed on the indicator sheet of one light emitting indicator unit as being displaced from the position at which it should originally be placed, by allowing the indicator sheet of the other light emitting indicator units to shine, visibility of the indicator sheet can be improved.

Further, with the heating cooker of the present invention, since each of the light emitting indicator units has a temperature sensing unit, the actual position of the heating target cooking vessel placed on the top board can be sensed based on the difference among the temperatures sensed by the temperature sensing units. Further, it is also possible to report to the user in which direction the heating target cooking vessel is disposed as being displaced from the position at which it should originally be placed.

BRIEF DESCRIPTION OF THE DRAWINGS

These and other aspects and features of the present invention will become clear from the following description taken in conjunction with the preferred embodiment thereof with reference to the accompanying drawings, in which.

DETAILED DESCRIPTION OF THE PREFERRED EMBODIMENTS

Figure 1:
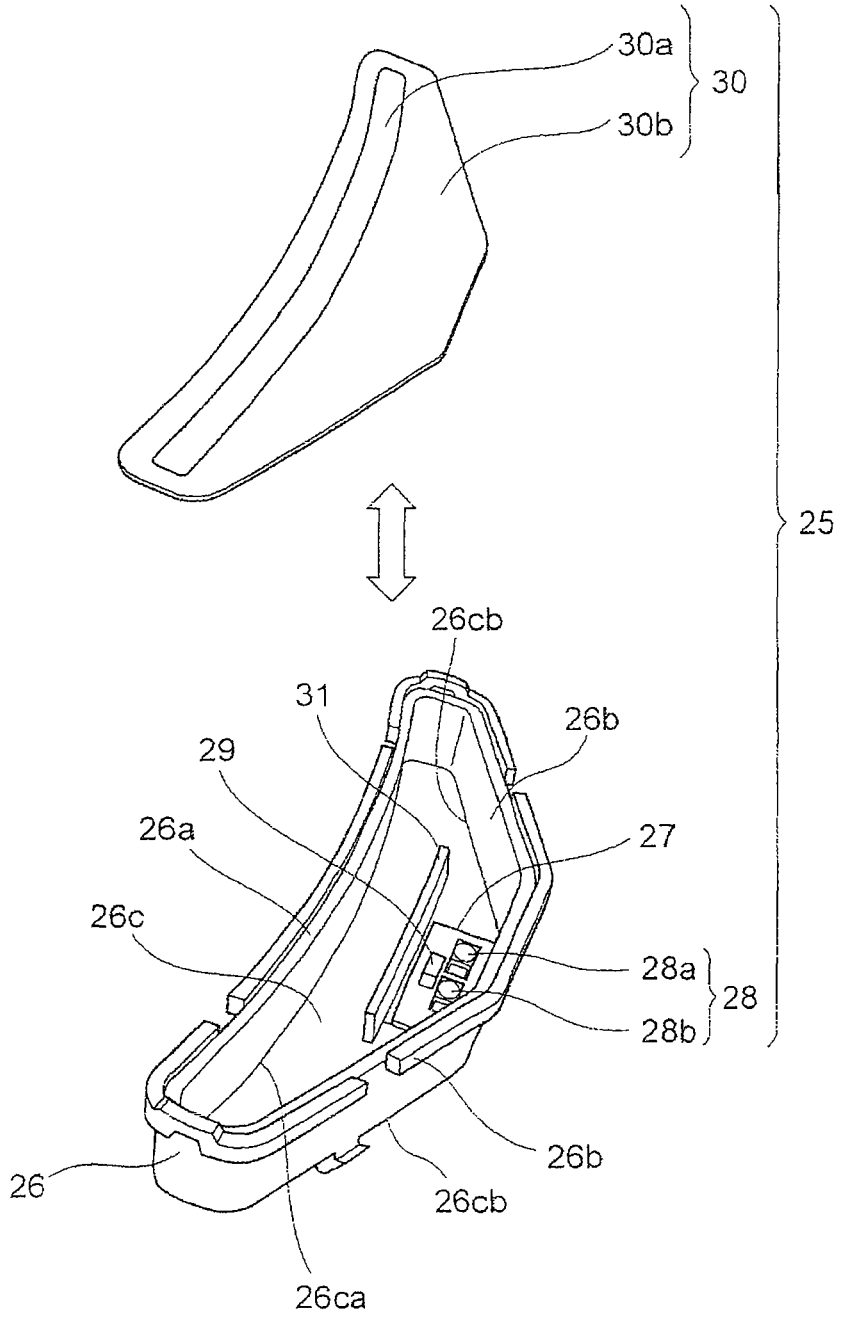
FIG. 1 is an exploded perspective view of a light emitting indicator unit included in a heating cooker according to an embodiment of the present invention.

Before the description of the present invention proceeds, it is noted that like parts are designated by like reference numerals throughout the accompanying drawings.

In the following, a description will be given of an embodiment of the present invention. Note that the present invention is not limited by the embodiment.

<<Embodiment>>

Figure 2:
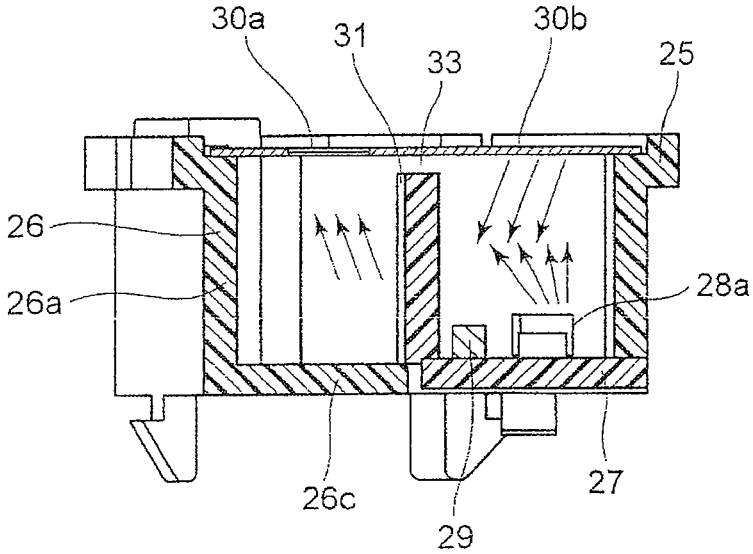
FIG. 2 is a cross-sectional view of a light emitting indicator unit included in the heating cooker according to the embodiment of the present invention.
Figure 3:
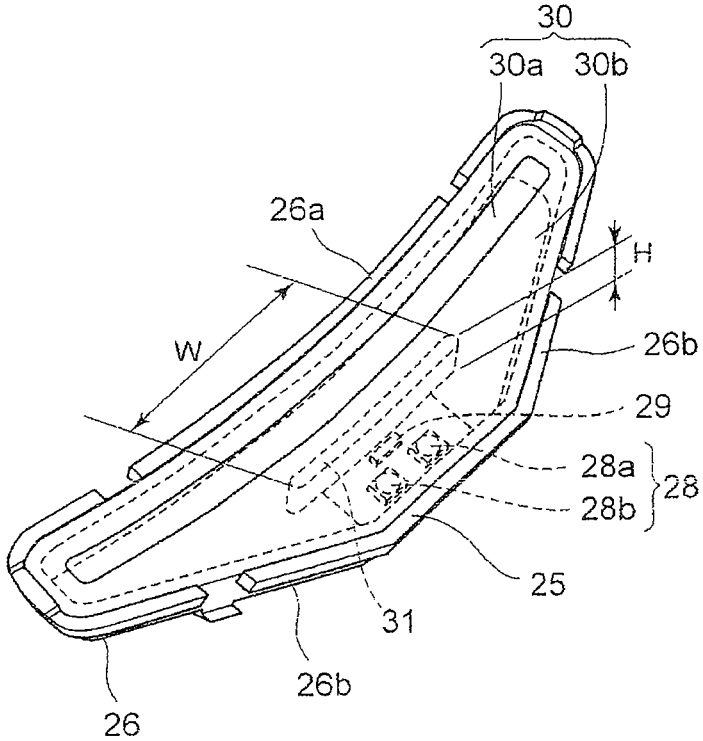
FIG. 3 is an assembly perspective view of the light emitting indicator unit included in the heating cooker according to the embodiment of the present invention.
Figure 4:
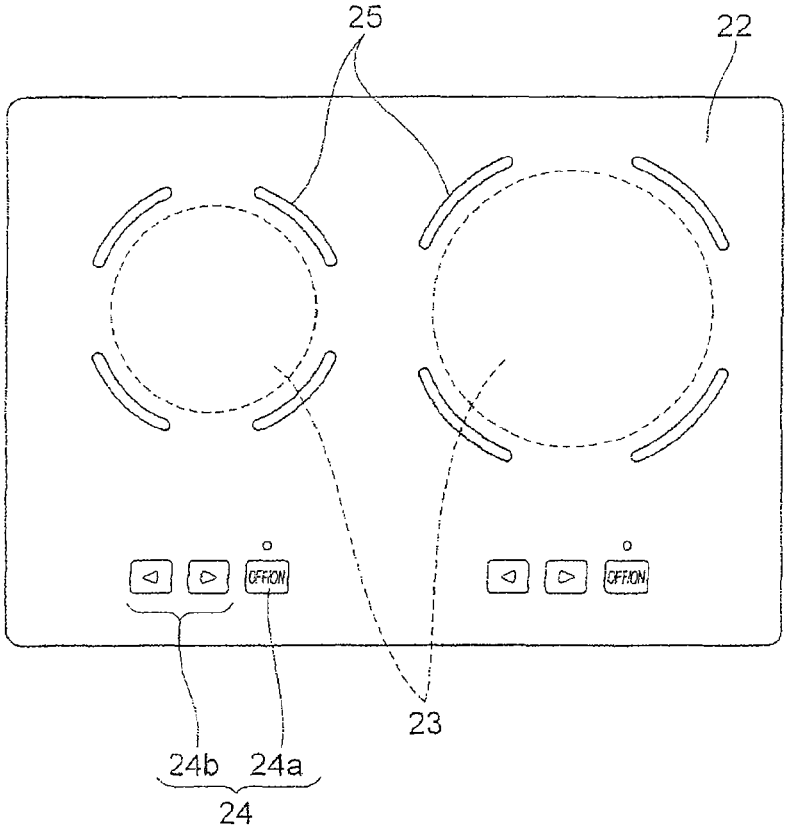
FIG. 4 is a plan view of the heating cooker according to the embodiment of the present invention.
Figure 5:
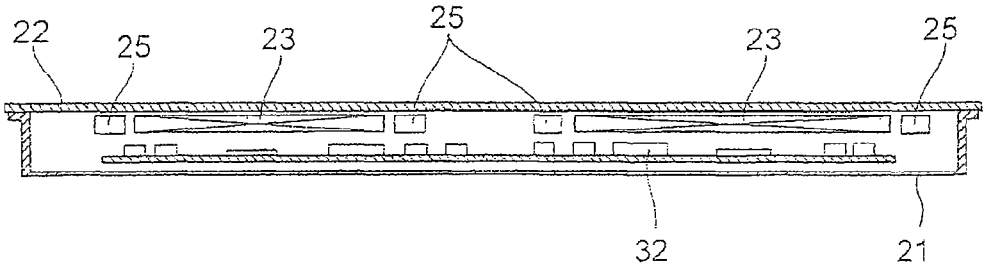
FIG. 5 is a cross-sectional view of the heating cooker according to the embodiment of the present invention.
Figure 6:
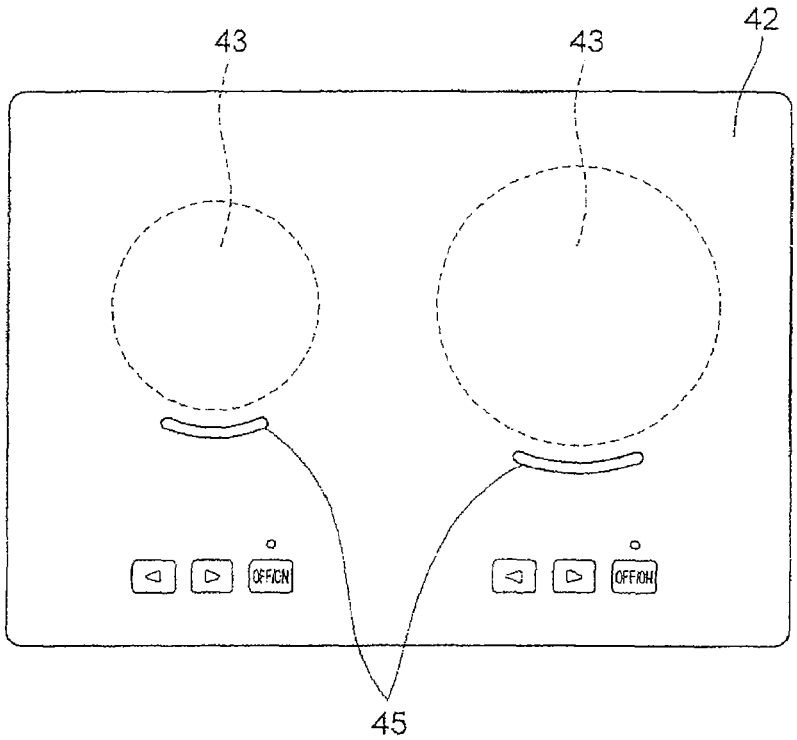
Fig. 6 Prior Art
FIG. 6 is a plan view of a conventional heating cooker.
Figure 7:
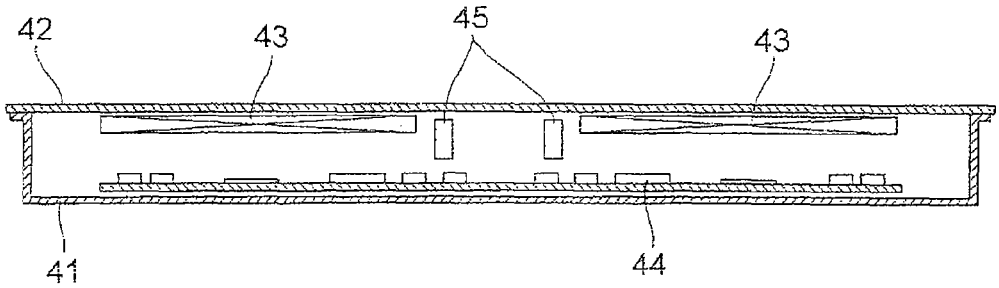
Fig. 7 Prior Art
FIG. 7 is a cross-sectional view of the conventional heating cooker.
Figure 8:
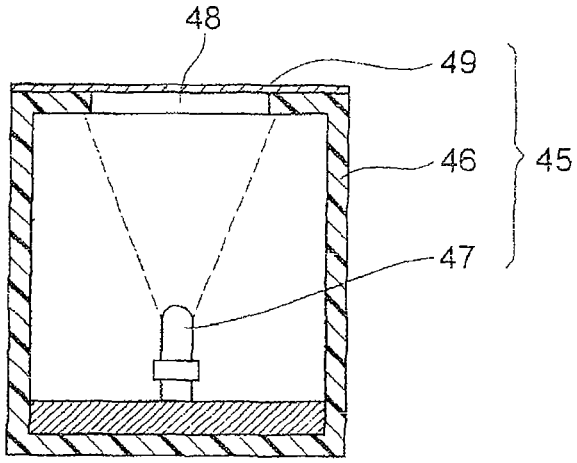
Fig. 8 Prior Art
FIG. 8 is a cross-sectional view of a light emitting indicator unit of the conventional heating cooker.
Figure 9:
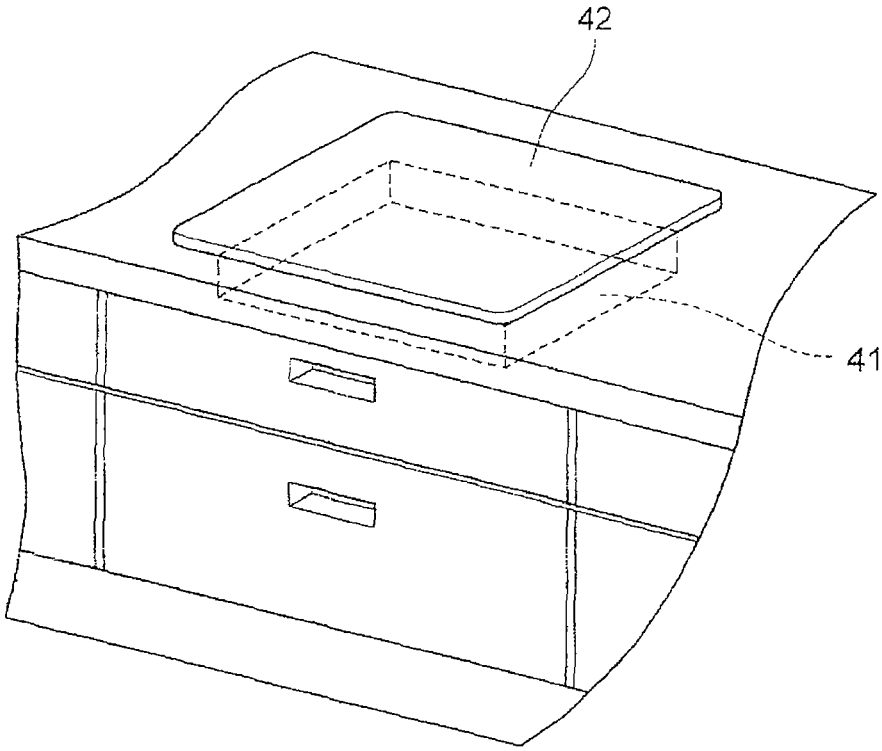
Fig. 9 Prior Art
FIG. 9 is a perspective view showing a state where the conventional heating cooker is installed in a kitchen cabinet.

With reference to FIGS. 1 to 5, a description will be given of a heating cooker according to an embodiment of the present invention. FIG. 1 is an exploded perspective view of a light emitting indicator unit included in the heating cooker according to the present embodiment. FIG. 2 is a cross-sectional view of the light emitting indicator unit included in the heating cooker according to the present embodiment. FIG. 3 is an assembly perspective view of the light emitting indicator unit of the heating cooker according to the present embodiment. FIG. 4 is a plan view of the heating cooker according to the present embodiment. FIG. 5 is a cross-sectional view of the heating cooker according to the present embodiment.

As shown in FIG. 4 or FIG. 5, the heating cooker according to the present embodiment includes a box-like body 21 having an opening at the top portion, and a flat plate-like top board 22 provided to close the opening of the body 21 on which a heating target cooking vessel (not shown) such as a pot is placed.

Inside the body 21, at least one heating unit 23 is disposed. FIGS. 4 and 5 each show an example where two heating units 23 are provided. Each of the heating units 23 is structured with, for example, an induction heating coil that heats the heating target cooking vessel via the top board 22. The output of the heating unit 23 can be adjusted by manipulating an operation button 24*a* and a manipulation button 24*b* of a manipulation unit 24 provided at the top board 22.

Beside each heating unit 23, a plurality of light emitting indicator units 25 are provided so as to conform to the substantially circular outer circumferential portion of the heating unit 23. The light emitting indicator units 25 indicate the position at which the heating target cooking vessel is to be placed when the heating target cooking vessel is heated by the heating unit 23, or the state that the heating unit 23 is in the heating state. FIG. 4 shows an example where four light emitting indicator units 25 are disposed at equal intervals for one heating unit 23.

As shown in FIGS. 1 to 3, each of the light emitting indicator units 25 includes a case 26 that has a light blocking characteristic, and a light emission source 28 that is provided in the case 26.

The case 26 is provided so that its top portion faces the top board 22. The top board 22 is structured such that at least a portion facing the top portion of the case 26 transmits light. A bottom wall 26*c* of the case 26 is substantially isosceles triangular. The case 26 is disposed such that the base 26*ca* side of the substantially isosceles triangular shape faces the outer circumferential portion of the heating unit 23. It is noted that the "substantial isosceles triangle" includes not only a perfect isosceles triangle, but also isosceles triangles being deformed, e.g., having their corners rounded or cut off, or having their sides formed to be arc-shaped. That is, the bottom wall 26*c* of the case 26 is only required to be in a shape that can generally be recognized as an isosceles triangle.

The base 26*ca* of the bottom wall 26*c* of the case 26 is formed to be arc-shaped so as to conform to the substantially circular outer circumferential portion of the heating unit 23. The base 26*ca* is provided with a reflective wall 26*a*, which is part of the outer circumferential wall (sidewall), in a standing manner. That is, the reflective wall 26*a* is formed to be arc-shaped so as to conform to the substantially circular outer circumferential portion of the heating unit 23.

The two equilateral sides 26*cb* and 26*cb* of the bottom wall 26*c* of the case 26 are each provided with a guide wall 26*b*, which is the other portion of the outer circumferential wall, in a standing manner. A substrate 27 is arranged near the apex being away from the base 26*ca* of the bottom wall 26*c*. On the substrate 27, the light emission source 28 and a temperature sensing unit 29 that senses the ambient temperature of the light emission source 28 are disposed (mounted).

The light emission source 28 has one or more point light sources. FIGS. 3 to 5 each show an example where two surface mount LEDs 28*a* and 28*b* are provided as point light sources. Here, an LED that emits white light is used as one LED 28*a*, and an LED that emits red light is used as the other LED 28*b*.

An opening is provided at the top portion of the case 26, and the opening is closed by an indicator sheet 30. The indicator sheet 30 includes a light transmitting portion 30*a* that transmits the light of the light emission source 28, and a light blocking portion 30*b* that blocks the light of the light emission source 28. The light transmitting portion 30*a* is formed arc-shaped so as to conform to the outer circumferential portion of the substantially circular heating unit 23. The light transmitting portion 30*a* is subjected to a light diffusion process so as to diffuse the light of the light emission source 28. The light diffusion process may include bonding of a light diffusion sheet, a grind process, or the like. The light blocking portion 30*b* is provided at the position away from the heating unit 23 further than the light transmitting portion 30*a* is. Below the light blocking portion 30*b*, the light emission source 28 is disposed. That is, the light emission source 28 is disposed so as not to position on the surface of projection of the light transmitting portion 30*a* of the indicator sheet 30 as seen from the top board 22 side.

As seen from the height direction of the light emitting indicator unit 25, between the light transmitting portion 30*a* and the light emission source 28, a light blocking wall 31 that blocks the light of the light emission source 28 is provided. The temperature sensing unit 29 is disposed on the same side as the light emission source 28 with reference to the light blocking wall 31. Between the light blocking wall 31 and the indicator sheet 30, a clearance 33 is provided so as to transmit the light of the light emission source 28.

Further, as shown in FIG. 5, below the heating unit 23 and the light emitting indicator unit 25, a control unit 32 is provided. The control unit 32 controls the heating unit 23 and the light emission source 28 based on the manipulated operation button 24*a* and manipulation button 24*b* of the manipulation unit 24.

Specifically, when there is any light emitting indicator unit 25 whose temperature sensed by the temperature sensing unit 29 becomes equal to or higher than a (first) reference temperature (e.g., 80° C.), the control unit 32 exerts control to reduce the current for energizing the light emission source 28 of the light emitting indicator unit 25, and to reduce the output of the heating unit 23. Further, when the temperature sensed by the temperature sensing unit 29 continues to be equal to or higher than the reference temperature for a prescribed time, the control unit 32 exerts control to stop energization of the light emission source 28 of the light emitting indicator unit 25, and to stop driving of the heating unit 23. It is noted that the reference temperature is a temperature equal to or lower than the heat resistant temperature of the light emission source 28. The "heat resistant temperature of the light emission source 28" refers to the heat resistant temperature of the electronic components such as the LEDs 28*a* and 28*b* included in the light emission source 28.

Further, in a case where a heating target cooking vessel is disposed as being displaced from the position at which it should originally be placed, thereby covering the indicator sheet 30 of one light emitting indicator unit 25, there occurs a difference among the temperatures sensed by the temperature sensing units 29 of the light emitting indicator units 25. The control unit 32 senses the position of the heating target cooking vessel placed on the top board 22 based on the difference among the temperatures sensed by the temperature sensing units 29 of the light emitting indicator units 25. Specifically, when the temperature difference between the temperature sensed by the temperature sensing unit 29 of one light emitting indicator unit 25 and the temperature sensed by the temperature sensing unit 29 of the other light emitting indicator unit 25 is equal to or greater than the second reference temperature (e.g., equal to or greater than 30° C.), the control unit 32 senses the position of the heating target cooking vessel placed on the top board 22. When the heating target cooking vessel is disposed as being displaced from the position where it should originally be placed, the control unit 32 exerts control to cause the light emission source 28 of at least one light emitting indicator unit 25 out of a plurality of light emitting indicator units 25 to emit light to report the event to the user. Here, as one example, the control unit 32 is to exert control to cause the light emission sources 28 to blink, the light emission sources 28 being of the light emitting indicator units 25 other than the light emitting indicator unit 25 whose indicator sheet 30 is covered by the heating target cooking vessel.

Next, a description will be given of an exemplary basic operation of the heating cooker according to the present embodiment.

First, when the operation button 24*a* is turned ON, the control unit 32 exerts control such that the LEDs 28*a* of all the light emitting indicator units 25 are energized and the LEDs 28*a* emit white light. The light from the LEDs 28*a* is reflected off the inner face of the case 26 or the face of the light blocking portion 30*b* on the light emission source 28 side, and guided to the light transmitting portion 30*a*. Thus, the light transmitting portion 30*a* is indirectly illuminated by the white light of the LEDs 28*a*, and the position where a heating target cooking vessel is to be placed is indicated.

Thereafter, when the heating target cooking vessel is placed on the top board 22 and the manipulation button 24*b* is pressed, the heating unit 23 is driven as being controlled by the control unit 32, and heating of the heating target cooking vessel is started. During this heating, by the control exerted by the control unit 32, the LEDs 28*b* are energized in place of the LEDs 28*a*, and the LEDs 28*b* of all the light emitting indicator units 25 emit red light. The light of the LEDs 28*b* is reflected off the inner face of the case 26 or the face of the light blocking portion 30*b* on the light emission source 28 side, and guided to the light transmitting portion 30*a*. Thus, the light transmitting portion 30*a* is indirectly illuminated by the red light of the LEDs 28*b*, and it is indicated that the heating unit 23 is in the heating state.

Here, in a case where the heating target cooking vessel is disposed as being displaced from the position at which it should originally be placed, thereby covering the indicator sheet 30 of one light emitting indicator unit 25, there occurs a difference among the temperatures sensed by the temperature sensing units 29 of the light emitting indicator units 25. When the difference becomes equal to or higher than a second reference temperature, the control unit 32 exerts control to reduce the current for energizing the LEDs 28*b* of the light emitting indicator units 25 whose temperature sensed by the temperature sensing units 29 is high, and reduces the output of the heating unit 23. Further, at this time, by the control exerted by the control unit 32, the LED 28*b* of the light emitting indicator unit 25 whose temperature sensed by the temperature sensing unit 29 is low is intermittently energized, and the LED 28*b* blinks. Thus, the light transmitting portion 30*a* of the light emitting indicator unit 25 whose temperature sensed by the temperature sensing unit 29 is low is indirectly illuminated by the red light of the LED 28*b* and blinks, and it is reported that the heating target cooking vessel is disposed as being displaced with reference to the position at which it should originally be placed.

After the report is made, when a state where the temperature sensed by the temperature sensing unit 29 is equal to or higher than the reference temperature continues for a prescribed time, by the control exerted by the control unit 32, the energization of the LED 28*b* is stopped, whereby the light transmitting portion 30*a* is put out, and the driving operation of the heating unit 23 is stopped.

On the other hand, after the report is made, in a case where the heating target cooking vessel is disposed at the position at which it should originally be placed and the temperature sensed by the temperature sensing unit 29 becomes lower than the reference temperature, the output of the heating unit 23 is recovered by the control of the control unit 32. Further, at this time, the LEDs 28*b* of all the light emitting indicator units 25 are continuously energized. Thus, the light transmitting portion 30*a* of every light emitting indicator unit 25 is indirectly illuminated by the red light of the LED 28*b*, and it is indicated that the heating unit 23 is in the heating state.

Thereafter, when the operation button 24*a* is turned OFF to stop the heating of the heating target cooking vessel, by the control exerted by the control unit 32, the LED 28*b* of every light emitting indicator unit 25 is intermittently energized, and the LED 28*b* blinks. Thus, the light transmitting portion 30*a* of every light emitting indicator unit 25 is indirectly illuminated by the red light of the LED 28*b* and blinks, and it is indicated that the position at which the heating target cooking vessel is to be placed is at a high temperature. Thereafter, after a lapse of a prescribed time, or when the temperature of the top board 22 lowers to reach a prescribed temperature, by the control exerted by the control unit 32, the energization of the LED 28*b* of every light emitting indicator unit 25 is stopped, whereby the light transmitting portion 30*a* is put off.

As has been described, with the heating cooker according to the present embodiment, since the temperature sensing unit 29 that senses the ambient temperature of the light emission source 28 is included, it becomes possible to sense abnormal heating of the light emission source 28 due to, e.g., the heating target cooking vessel being heated while empty. Thus, it becomes possible to take actions such as reporting the abnormal heating of the light emission source 28 to the user, automatically reducing the current for energizing the light emission source 28, and automatically reducing the output of the heating unit 23, and it becomes possible to suppress deterioration of the light emission source 28. Accordingly, it becomes possible to suppress the height of the light emitting indicator unit 25, whereby a further reduction in thickness of the heating cooker can be realized.

It is noted that, when the ambient temperature of the light emission source 28 is high, the permissible current value of the light emission source 28 becomes low. Therefore, when the current value for energizing the light emission source 28 is set to be the same as a normal value, the light emission source 28 tends to deteriorate. On the other hand, with the heating cooker according to the present embodiment, when there is any light emitting indicator unit 25 whose temperature sensed by the temperature sensing unit 29 becomes equal to or higher than the reference temperature, the current for energizing the light emission source 28 of the light emitting indicator unit 25 is reduced, and hence, deterioration of the light emission source 28 can be suppressed.

Further, with the heating cooker according to the present embodiment, since a plurality of light emitting indicator units 25 are included, even in a case where the heating target cooking vessel is displaced from the position at which it should originally be placed and is disposed on the indicator sheet 30 of one light emitting indicator unit 25, by causing the light transmitting portions 30*a* of the other light emitting indicator units 25 to shine, visibility of each indicator sheet 30 can be improved.

Further, with the heating cooker according to the present embodiment, since the light emitting indicator units 25 each have the temperature sensing unit 29, it becomes possible to sense the actual position of the heating target cooking vessel placed on the top board 22 based on the difference among the temperatures sensed by the temperature sensing units 29. Further, it becomes also possible to report to the user that in which direction the heating target cooking vessel is disposed as being displaced from the position at which it should originally be placed. Accordingly, it is possible to urge the user to dispose the heating target cooking vessel at the position at which it should originally be placed.

Further, with the heating cooker according to the present embodiment, the light emission source 28 is disposed below the light blocking portion 30*b* of the indicator sheet 30, such that the light of the light emission source 28 cannot directly be seen from the light transmitting portion 30*a* of the indicator sheet 30. That is, the light transmitting portion 30*a* of the indicator sheet 30 is indirectly illuminated by the light of the light emission source 28. Thus, uneven shining of the indicator sheet 30 can drastically be suppressed.

Further, with the heating cooker according to the present embodiment, since the light blocking portion 30*b* is provided at the position away from the heating unit 23 than the light transmitting portion 30*a* is, the light emission source 28 disposed below the light blocking portion 30*b* is disposed to be away from the heating target cooking vessel disposed above the heating unit 23. Accordingly, the effect of the heat from the heating target cooking vessel to the light emission source 28 becomes small, and a reduction in brightness or lifetime of the light emission source 28 can be suppressed.

Accordingly, with the heating cooker according to the present embodiment, the space between the light emission source 28 and the indicator sheet 30 can be narrowed and the height of the light emitting indicator unit 25 can be suppressed. Thus, a further reduction in thickness of the heating cooker can be achieved.

Further, with the heating cooker according to the present embodiment, the light emission source 28 is disposed near the apex, which is away from the base 26*ca* of the bottom wall 26*c* of the case 26. That is, the light emission source 28 is disposed at the position in the case 26 farthest from the outer circumferential portion of the heating unit 23. Thus, a reduction in the effect of heat from the heating target cooking vessel to the light emission source 28 can be achieved, and a reduction in brightness or lifetime of the light emission source 28 can further be suppressed. Further, disposition of the light emission source 28 near the apex being away from the base 26*ca* allows the light of the light emission source 28 to be guided to the guide wall 26*b* provided to each of the two equilateral sides 26*cb* in a standing manner, and to arrive at the light transmitting portion 30*a* further evenly and at higher brightness. Accordingly, it becomes possible to eliminate the necessity of providing the light emission sources 28 at a plurality of places in the case 26 for the purpose of allowing the light transmitting portion 30*a* to shine evenly at high brightness.

Further, with the heating cooker according to the present embodiment, since the reflective wall 26*a* of the case 26 is formed to be arc-shaped so as to conform to the outer circumferential portion of the heating unit 23, the distance between the reflective wall 26*a* and the heating unit 23 can be reduced. Thus, when a plurality of heating units 23 are disposed next to one another, it becomes possible to reduce the distance between each ones of the heating units 23, and to structure the heating cooker in a compact manner, or to dispose more heating units 23 within the same space.

Further, with a conventional heating cooker, since the light emission source is structured with a lead type bullet LED, the height of the tip portion of the light emission source becomes the sum of the height of the LED body and that of the lead portion. In contrast, with the heating cooker according to the present embodiment, since the surface mount LEDs 28*a* and 28*b* are used as the light emission source 28, the size thereof is small and no lead portion is present. Therefore, the height of the light emission source 28 can be reduced by that amount. Thus, it becomes possible to suppress the height of the light emitting indicator unit 25 to further reduce the thickness of the heating cooker.

Further, with the heating cooker according to the present embodiment, since the light diffusion process is provided to the light transmitting portion 30*a* of the indicator sheet 30, even when the light of the light emission source 28 guided to the light transmitting portion 30*a* is uneven to some extent, uneven shining of the light transmitting portion 30*a* can be suppressed and the appearance can largely be improved.

Further, in a case where the distance between the light emission source 28 and the reflective wall 26*a* is reduced for the purpose of reducing the area occupied by the light emitting indicator unit 25, the distance between the light emission source 28 and the light transmitting portion 30*a* becomes small. In this case, the proportion of the direct light, which is the light of the light emission source 28 directly arriving at the light transmitting portion 30*a*, increases, and uneven shining of the light transmitting portion 30*a* becomes great. Specifically, while the portion near the light emission source 28 of the light transmitting portion 30*a* brightens up, the end portion away from the light emission source 28 of the light transmitting portion 30*a* darkens.

On the other hand, with the heating cooker according to the present embodiment, since the light blocking wall 31 is provided between the light transmitting portion 30*a* and the light emission source 28, by adjusting the size of the light blocking wall 31, the direct light, which is the light of the light emission source 28 directly arriving at the light transmitting portion 30*a*, can be reduced. Thus, brightness balance between the portion near the light emission source 28 of the light transmitting portion 30*a* and the end portion being away from the light emission source 28 of the light transmitting portion 30*a* can be adjusted, and even in a case where the distance between the light emission source 28 and the light transmitting portion 30*a* is reduced, uneven shining of the light transmitting portion 30*a* can be suppressed. Accordingly, it becomes possible to reduce the distance between the light emission source 28 and the light transmitting portion 30*a* to thereby reduce the area occupied by the light emitting indicator unit 25.

Further, in a case where the light blocking wall 31 is provided, the portion near the light blocking wall 31 of the light transmitting portion 30*a* tends to darken. This becomes specifically significant, particularly when the height H and the width W of the light blocking wall 31 are increased.

Addressing to this issue, with the heating cooker according to the present embodiment, the clearance 33 is provided between the light blocking wall 31 and the indicator sheet 30. Therefore, by adjusting the size of the clearance 33, brightness of the portion near the light emission source 28 of the light transmitting portion 30*a* can be adjusted.

Further, with the heating cooker according to the present embodiment, since the light emission source 28 has the LED 28*a* that emits white light and the LED 28*b* that emits red light, the color of light shone from the light transmitting portion 30*a* can be changed in accordance with the purpose, such as indication of the position where the heating target cooking vessel is to be placed. Thus, visibility can be improved. It is noted that, the timing of the LEDs 28*a* and 28*b* for turning on, the blinking manner of the LEDs 28*a* and 28*b*, the color of emitted light and the like are not limited to those described above, and can be set as appropriate.

It is noted that the present invention is not limited to the embodiment described above, and can be practiced in other various manners. For example, in the foregoing, only one of the LEDs 28*a* and 28*b* is turned on or blinked, and not both of them are turned on. However, the present invention is not limited thereto, and both of the LEDs 28*a* and 28*b* may be turned on. By simultaneously causing both the LED 28*a* that emits white light and the LED 28*b* that emits red light to turn on, it becomes possible to allow the light transmitting portion 30*a* to shine in pink. That is, with the two LEDs 28*a* and 28*b*, it becomes possible to allow the light transmitting portion 30*a* to shine in three colors, namely, white, red, and pink. Thus, it becomes possible to allow the light transmitting portion 30*a* to shine in various colors. By changing the shining color of the light transmitting portion 30*a* in accordance with the purpose, visibility can further be improved. Further, when the heating target cooking vessel is disposed as being displaced from the position at which it should originally be placed, it is preferable that the control unit 32 controls the light emission source 28 of at least one light emitting indicator unit 25, so that it emits light of a different color from that when the heating target cooking vessel is disposed at the position at which it should originally be placed. Thus, visibility can further be improved. It is noted that, when the light emission source 28 is structured with three LEDs respectively that emit light in three colors, namely red, blue, and green, it becomes possible to allow the light transmitting portion 30*a* to shine in substantially every color. Further, the light emission source 28 can be structured with a single LED that emits a plurality of colors (e.g., red, blue, and green).

Further, it has been described that, when there is any light emitting indicator unit 25 whose temperature sensed by the temperature sensing unit 29 becomes equal to or higher than the reference temperature, the current for energizing the light emission source 28 of the light emitting indicator unit 25 is reduced, and the output of the heating unit 23 is reduced. However, the present invention is not limited thereto. For example, the following manner is also possible: when there is any light emitting indicator unit 25 whose temperature sensed by the temperature sensing unit 29 becomes equal to or higher than the reference temperature, energization of the light emission source 28 of the light emitting indicator unit 25 may immediately be stopped, and driving of the heating unit 23 may immediately be stopped. Further, the timing of reducing the current for energizing the light emission source 28 and the timing of reducing the output of the heating unit 23 may not coincide with each other. Similarly, the timing of stopping energization of the light emission source 28 and the timing of stopping driving of the heating unit 23 may not coincide with each other.

Further, though it has been described that the light blocking wall 31 has only the light blocking characteristic, the present invention is not limited thereto. For example, it is also possible to form the light blocking wall 31 with a heat insulating material or the like such that the light blocking wall 31 has both the light blocking characteristic and the heat blocking characteristic. Thus, the effect of heat from the heating target cooking vessel to the light emission source 28 can further be reduced, and a reduction in the brightness or lifetime of the light emission source 28 can further be suppressed.

Industrial Applicability

The heating cooker of the present invention is a heating cooker including light emitting indicator units. It is capable of suppressing deterioration of the light emission source of each of the light emitting indicator units and realizing a further reduction in thickness, and is capable of improving visibility of indicator sheets. Therefore, it is particularly useful as an induction heating cooker installed in a kitchen cabinet.

Although the present invention has been fully described in connection with the preferred embodiments thereof with reference to the accompanying drawings, it is noted that various changes and modifications are apparent to those skilled in the art. Such changes and modifications are to be understood as included within the scope of the present invention as defined by the appended claims unless they depart therefrom.

The entire disclosure of Japanese Patent Application No. 2009-172691 filed on Jul. 24, 2009, including specification, claims, drawings, and summary are incorporated herein by reference in its entirety.

The invention claimed is:

1. A heating cooker, comprising:

a box-like body having an opening at a top portion of the body;

a top board that is provided over the opening of the body;

a heating unit that is provided inside the body and that is configured to heat a heating target cooking vessel placed on the top board;

a plurality of light emitting indicator units that are provided inside the body beside the heating unit; and a control unit in communication with and configured to control the heating unit and the light emitting indicator units, wherein the light emitting indicator units each comprise:

a case having an opening at a top portion of the case facing the top board;

a light emission source located inside the case;

a temperature sensing unit located inside the case and configured to sense an ambient temperature of the light emission source; and an indicator sheet positioned on top of the case to close the opening of the case, wherein the indicator sheet comprises:

a light transmitting portion that passes light of the light emission source; and a light blocking portion that is provided at a position farther away from the heating unit than the light transmitting portion in a lateral direction in a common plane and that is provided directly above the light emission source in a height direction that is perpendicular to the lateral direction, the light blocking portion blocking the light of the light emission source.

2. The heating cooker according to claim 1, wherein when any light emitting indicator unit whose temperature sensed by the temperature sensing unit becomes equal to or higher than a reference temperature out of a plurality of the light emitting indicator units, the control unit reduces a current for energizing the light emission source of the light emitting indicator unit.

3. The heating cooker according to claim 1, wherein when any light emitting indicator unit whose temperature sensed by the temperature sensing unit becomes equal to or higher than a reference temperature out of a plurality of the light emitting indicator units, the control unit reduces an output of the heating unit.

4. The heating cooker according to claim 1, wherein the light blocking wall comprises a heat insulating material.

5. The heating cooker according to claim 4, wherein a clearance that passes the light of the light emission source is provided between the light blocking wall and the indicator sheet.

6. The heating cooker according to claim 4, wherein the light blocking wall has a heat insulating characteristic.

7. The heating cooker according to claim 1, wherein the control unit senses a position of the heating target cooking vessel placed on the top board based on a difference among temperatures sensed by the temperature sensing units of the light emitting indicator units.

8. The heating cooker according to claim 7, wherein when the heating target cooking vessel is disposed as being displaced from a position at which the heating target cooking vessel is to be placed, the control unit allows a light emission source of at least one light emitting indicator unit out of a plurality of the light emitting indicator units to emit light so as to report to a user.

9. The heating cooker according to claim 8, wherein when the heating target cooking vessel is disposed as being displaced from the position at which the heating target cooking vessel is to be placed, the control unit allows the light emission source of at least one light emitting indicator unit out of a plurality of the light emitting indicator units to emit light in a color being different from a color that is emitted when the heating target cooking vessel is disposed at the position at which the heating target cooking vessel is to be placed.

10. The heating cooker according to claim 1, wherein at least one light emitting indicator unit out of a plurality of the light emitting indicator units has a light blocking wall between the light transmitting portion of the indicator sheet and the light emission source as seen from the height direction, the light blocking wall blocking the light of the light emission source oriented to the light transmitting portion of the indicator sheet.

* * * * *